US005238333A

United States Patent [19]

Dugge et al.

[11] Patent Number: 5,238,333

[45] Date of Patent: Aug. 24, 1993

[54] PNEUMATIC OUTLET FOR RAILCARS

[75] Inventors: Richard H. Dugge, County of St. Louis; William U. Casseau, St. Louis, both of Mo.

[73] Assignee: ACF Industries, Incorporated, Earth City, Mo.

[21] Appl. No.: 917,341

[22] Filed: Jul. 23, 1992

[51] Int. Cl.[5] ..... B65G 53/40; B61D 7/02

[52] U.S. Cl. ..... 406/145; 105/247; 222/556

[58] Field of Search ..... 406/145, 128, 130, 131; 105/247, 248, 280, 283; 222/556

[56] References Cited

U.S. PATENT DOCUMENTS

| | | | |
|---|---|---|---|
| 3,350,141 | 10/1967 | McGrath . | |
| 3,482,741 | 12/1969 | Fritz | 222/554 |
| 3,701,460 | 10/1972 | Dugge et al. | 222/193 |
| 3,778,114 | 12/1973 | Carney, Jr. et al. . | |
| 3,779,172 | 12/1973 | Schipper et al. . | |
| 4,114,785 | 9/1978 | Dugge | 222/545 |
| 4,382,225 | 5/1983 | Dugge | 406/131 |

*Primary Examiner*—David M. Mitchell
*Assistant Examiner*—James M. Kannofsky
*Attorney, Agent, or Firm*—Polster, Lieder, Woodruff & Lucchesi

[57] ABSTRACT

An improved pneumatic outlet (10) is for use on a railcar (C) for discharging a lading from a hopper (H) of the railcar. The outlet comprises an integrally formed bottom cover (12) extending the length of the outlet. A pair of outlet valves (50A, 50B) are installed in the cover. The valves are mounted on respective valve shafts (54A, 54B) and are installed in the cover in a diagonal arrangement. Accordingly, each valve allows discharge of lading from one side of the hopper. A bulkhead (40) is also installable in the cover and supports an inner end of the respective valve shafts. The cover is severable into two sections (36A, 36B). One of the sections is reversible with respect to the other section. Thereafter, the two sections are joined together to form a unified cover through which lading flows during discharge. The bulkhead fits within the reunified cover such that no gaps or other deformities are present which would collect material that may contaminate a lading.

24 Claims, 4 Drawing Sheets

PNEUMATIC OUTLET FOR RAILCARS

BACKGROUND OF THE INVENTION

This invention relates to outlets for covered hopper railway cars and, more particularly, to an improved pneumatic outlet for such cars.

Pneumatic outlets for offloading lading from railcars such as covered hopper railway cars are well known in the art. See, for example, U.S. Pat. Nos. 4,382,725, 4,114,785, 3,778,114, 3,701,460, and 3,350,141, all of which are assigned to the same assignee as the present invention. An outlet of the type described in these patents includes a bottom cover extrusion which extends across the car from one side to the other. The extrusion is attached to respective side sheets and end sheets to complete the outlet body. A pair of outlet valves are housed within the bottom cover extrusion and are diagonally spaced with respect to each other. When installed, one valve covers one-half of the hopper, and the other valve the opposite half.

During outlet fabrication, a bulkhead sub-assembly is fitted into the bottom extrusion. This sub-assembly is used for mounting the inner end of respective valve shafts so the valves can be installed in their diagonally spaced configuration. The sub-assembly is force fitted into place. When installed, there are typically gaps and flat spots between the bottom cover extrusion and the sub-assembly. After installation, the sub-assembly is welded to the inside of the bottom cover. At that time, any gaps or flat spots are taken off. However, because of the size and geometry of the cover/bulkhead assembly, it is not always possible to eliminate all of the distortions between the two. Accordingly, gaps, for example, may remain.

Certain ladings carried in covered hopper cars are required to be essentially free of any contaminating material. The presence of contaminants in this material can it render it worthless. The presence of gaps in the outlet assembly provides locations where lading material can lodge during an unloading operation. If this material is dislodged during a subsequent unloading, the lading then being unloaded may be contaminated. It will be understood that not just particles from a prior lading, but dirt or other material may lodge in the gap and also act as a contaminant.

A second difficulty encountered during outlet fabrication is in aligning the outer end of the respective shafts. These outer ends are first installed on the end sheets of the assembly, and then connected to an adaptor. These adaptors are used for connecting the fluid discharge equipment to the outlet for unloading. The end sheets and adaptors are bolted together. Prior to doing this, the assembler must maneuver the shaft/end sheet assembly so to insure a proper alignment between the outlet valves and the sidewall of the outlet. He may, for example, do this using a feeler gauge. Once everything is aligned, he bolts the adaptor and end sheet together. It will be appreciated, however, that if there is even a small misalignment, additional gaps are formed in the outlet assembly which may add to the potential for contamination.

SUMMARY OF THE INVENTION

Among the several objects of the present invention may be noted the provision of an improved pneumatic outlet for use on railway cars such as covered hopper cars; the provision of such an outlet having diagonally spaced valves to facilitate unloading of lading from both sides of the hopper, and a divider assembly for facilitating installation of the valves; the provision of such an outlet having a continuously formed extrusion forming a bottom cover of the outlet; the provision of such a bottom cover to be divided into separate pieces whose ends are reversible and attachable together to form a bottom cover; the provision of such an outlet to further include a divider for mounting the inner ends of the outlet valves, such a divider being installable in the cover so as to have no gaps or deformations between the divider and the cover; the provision of such an improved outlet in which a better fit of the various components is achieved thereby to eliminate distortions such as gaps; the provision of such an improved outlet to eliminate the possibility of lading contamination; the provision of such an improved outlet in which the outer ends of the valve shafts are more easily aligned to further help eliminate distortions; the provision of such an improved outlet requiring fewer components thereby to simplify assembly and lower costs; and, the provision of a method for fabricating such an improved outlet so it is readily and efficiently produced.

In accordance with the invention, generally stated, an improved pneumatic outlet is for use on a railcar for discharging a lading from a hopper of the railcar. The outlet comprises an integrally formed bottom cover extending the length of the outlet. A pair of outlet valves are installed in the cover. The valves are mounted on respective valve shafts and are installed in the cover in a diagonal arrangement. Accordingly, each valve allows discharge of lading from one side of the hopper. A bulkhead is also installable in the cover and supports an inner end of the respective valve shafts. The cover is severable into two sections. One of the sections is reversible with respect to the other section. Thereafter, the two sections are joined together to form a unified cover through which lading flows during discharge. The bulkhead fits within the reunified cover such that no gaps are other deformities are present which would collect material that may contaminate a lading. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
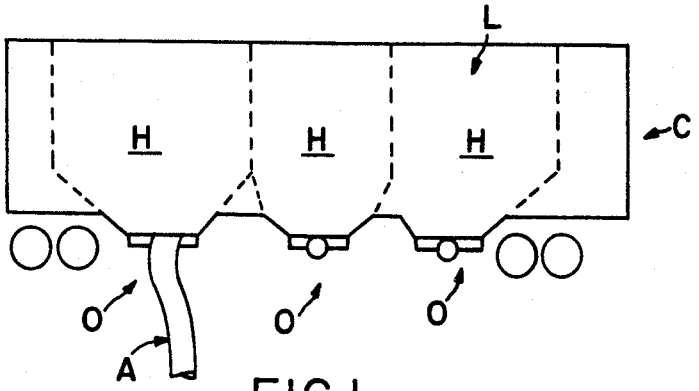
FIG.1 PRIOR ART
FIG. 1 illustrates a prior art outlet installed on a covered hopper railway car.

Referring to the drawings, a covered hopper railway car C has a plurality of hoppers H in which lading L is transported. The lading may be, for example, a particulate or pelletized lading; although, the type of lading is immaterial with respect to the present invention. An outlet O is installed at the bottom of each hopper for use in discharging lading. As is well-known in the art, a pneumatic discharge apparatus generally indicated A is attached to outlet O when lading is to be discharged. The outlet has a pair of outlet valves V which, when opened, allow the lading to flow into a discharge tube T of the outlet. Lading material is then entrained in an airstream and drawn off through apparatus A to a storage site (not shown).

Figure 2:
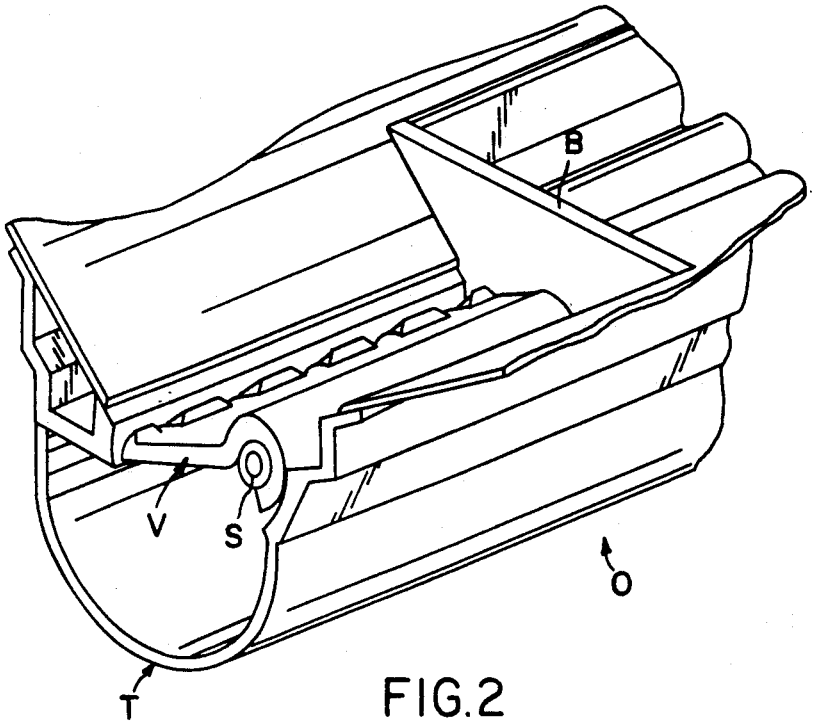
FIG.2 PRIOR ART
FIG. 2 is a view of the outlet in FIG. 1.

As shown in the sectional view of FIG. 2, a bulkhead divider B is used to divide the outlet into two sections. An outlet valve V mounted on a shaft S is installed in each section with one end of each shaft being mounted on the bulkhead. Design of discharge tube T has been such that bulkhead B is force fit into the tube during fabrication of the outlet. Thereafter, the bulkhead is welded in place. Because of the contour of the discharge tube, the difficulty in fitting the bulkhead in place, and the relative inaccessibility of portions of the bulkhead and tube during welding operations, gaps G may be formed because of flat spots or similar distortions. The presence of gaps is harmful in that particles of lading may be caught up in the gaps during an unloading operation. This material may then subsequently dislodge due to road vibrations or a later unloading operation. The harm results because many ladings have strict purity requirements. Accordingly, the presence of even a few particles of a contaminant, the prior lading, dirt, etc., may substantially reduce the value of a lading.

Figure 5A:
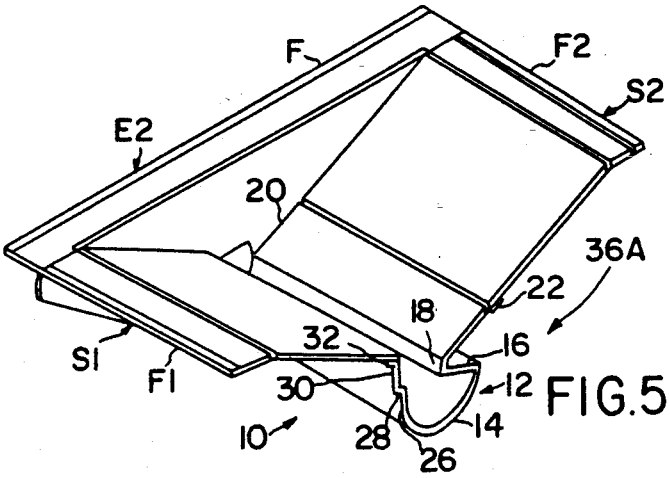
FIG. 5A is a perspective view of a bottom cover portion of the outlet during assembly of the outlet.
Figure 5B:
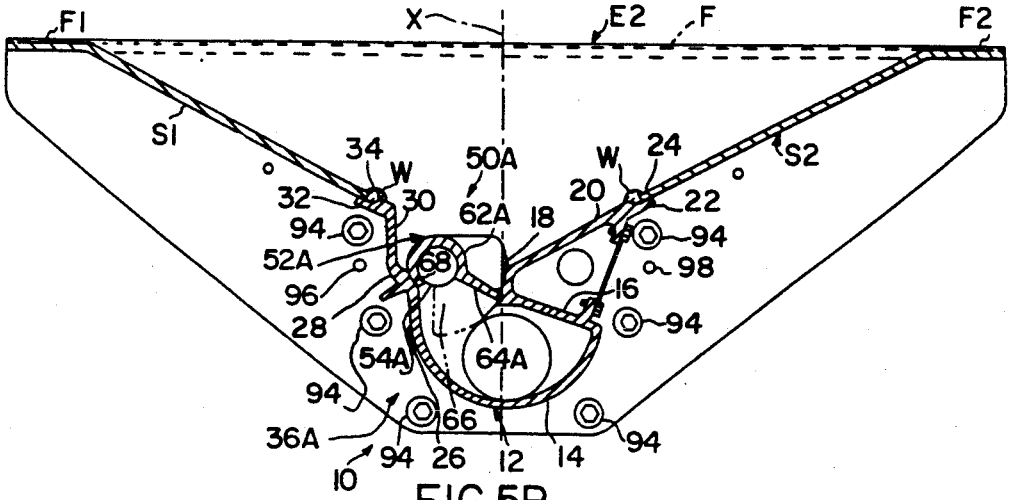
FIG. 5B is an elevational view of the bottom cover.

An improved pneumatic outlet 10 of the present invention is for use on a railway car C for discharging the lading from a hopper H on the railcar. Outlet 10 first includes an integrally formed bottom cover 12 which extends the length of the outlet. As shown in FIGS. 5A and 5B, this bottom cover includes a rounded lengthwise extending section 14 which forms the discharge tube of the assembled outlet. Section 14 is generally semi-circular in shape.

Figure 7A:
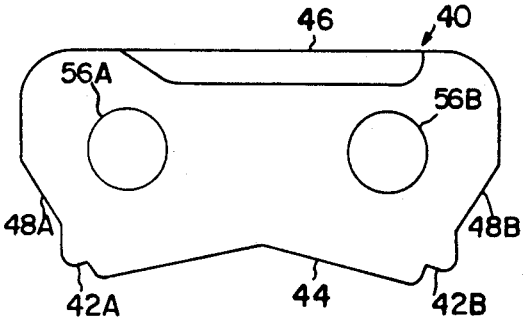
FIG. 7A is an elevational view of a bulkhead spacer used in the outlet.
Figure 7B:
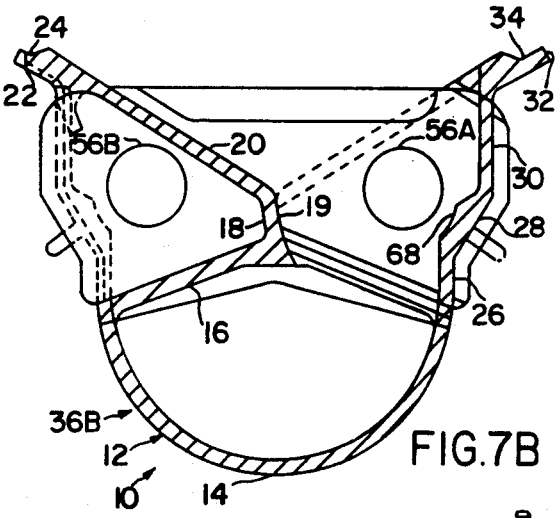
FIG. 7B is a sectional view of the outlet taken along line 7B—7B in FIG. 4 and showing the spacer installed in the bottom cover; and, FIG. 8 is an elevational view of the outlet and an end adaptor installed on the outlet.

At the upper end of section 14, at one side (the right side as viewed in FIGS. 5A and 5B), cover 12 has an inwardly and upwardly angled section 16. Section 16 extends inwardly to the centerline X of the bottom cover. A short, vertical section 18 extends upwardly from the inner end of section 16. As shown in FIG. 7B, the inner wall 19 of section 18 is curved for reasons which are described hereinafter. At the upper end of section 18, the cover has an outwardly and upwardly flaring section 20. The outer end 22 of section 20 has a shallow recess 24 which is formed in the top face of section 20 and extends the length of the cover.

At the upper end on the other side of the bottom cover, rounded section 14 flattens to form a generally vertically extending section 26. The upper end of section 26 extends a short distance above the lower end of cover section 16. An arcuate section 28 bows concavely outwardly at the upper end of section 26. A vertical section 30 extends upwardly from the upper end of arcuate section 28. The upper end 32 of this vertical section flares outwardly, and a recess 34, also extending the length of the bottom cover is formed in the upper face of end 32. The upper end 32 of cover 12 corresponds in height to that of upper end 22 of the cover.

As shown in FIGS. 5A and 5B, cover 12 attaches to end sheets (only one of which is shown in the drawings) at each end of the outlet assembly and to side sheets S1 and S2. Referring to FIG. 5B, it is shown that the lower end of the side sheets fit in the respective recesses 24 and 34 at the upper ends of the bottom cover. This results in a flush surface between the side sheets and bottom cover when the bottom cover is attached to the side sheets, by welding, for example, during fabrication of outlet 10. Each end sheet comprises a vertically extending metal sheet (a sheet of stainless steel, for example) having an outwardly extending, horizontal flange F at its upper end. The side sheets are both sloping sheets of metal with outwardly extending horizontal flanges F1 and F2 respectively. The flanges have spaced openings (not shown) by which the assembled outlet 10 may be attached to the bottom of a hopper H for discharge of lading into the outlet. A weldment W is indicated in FIG. 5B at the point of attachment between the side sheets and bottom cover 12. After welding, any excess material is removed to provide the smooth discharge surface for lading. Otherwise, catchments may be formed in which pellets or particles of lading collect.

In fabricating the outlet, bottom cover 12 is first cut in two. The sections 36A, 36B formed as a result of this operation are equal in length. Next, one of the sections, section 36B, is turned around so that its farthest end from section 36A is brought into abutment with section 36A. The sections may then be tack welded together. At the upper ends of the bottom cover sections; i.e., that portion of the cover comprised by sections 16–32, a recess 38 is formed. This is done by beveling or inwardly angling the abutting surfaces of the respective sections 36A, 36B so that an opening is formed between the respective upper portions of the cover sections.

A spacer 40 (see FIG. 7A) is inserted into the bottom cover through the recess. Spacer 40, which forms a bulkhead between the two bottom cover sections, is generally rectangular in shape and has a width greater than that of the upper portion of the cover sections Thus, when in place, the spacer extends beyond the upper sides of the bottom cover, on both sides of the cover. Respective notches 42A, 42B are formed at the lower corners of the spacer. This allows the spacer to be properly fit into the bottom cover, since the notches rest on the bottom cover sections at the lower end of recess 38 on either side of the bottom cover. Bottom 44 of the spacer has an inverted V-shape, while its upper end 46 is either flat or slightly rounded. Sides 48A, 48B extend generally vertically from the bottom of the spacer, then angle outwardly, and finally extend vertically again. The upper ends of the spacer are rounded. Because the width of the spacer exceeds the width of the bottom cover sections, the outer walls of the respective sections overlay the respective sidewalls of the spacer. Also, The height of the spacer is such that its lower end extends below section 16 of either bottom cover section.

These latter features are important because when sections 36A, 36B are welded together, spacer 40 is also welded in place between the two sections. Also importantly, the inside surface of the respective bottom cover sections, which are also welded to the spacer, are more easily welded in place than the bulkhead B used in prior outlets. Because spacer 40 is not forced fit in place, as is bulkhead B, the discontinuities which occurred in fabrication of the prior outlets do not occur in outlet 10. Whereas gaps sometimes developed in the area in FIG. 7B, no such gaps now occur. Further, no flat spots between the spacer and cover sections occur either. As a result, the sub-assembly comprising the cover sections and spacer have no gaps or other irregularities by which particles of lading being discharged from a hopper can become entrapped and be a potential contaminant to subsequent ladings.

Figure 6:
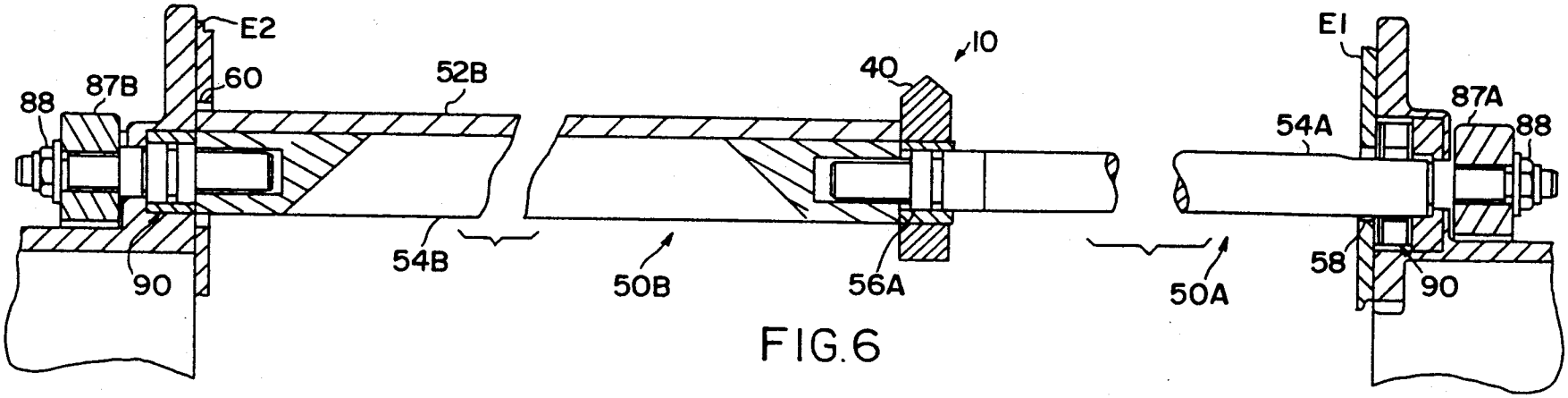
FIG. 6 illustrates installation of a valve in the outlet.

Outlet 10 next includes a pair of outlet valves 50A, 50B installable in cover 14. The valves are identical in construction. As shown in FIGS. 5B and 6, each valve includes a valve member (52A, 52B) mounted on a valve shaft (54A, 54B). The inner end of the respective shafts are installed in spaced openings 56A, 56B in spacer 40 (see FIG. 7A). The outer ends of the respective shafts are installed in openings in the end sheets. Thus, the outer end of valve shaft 52A is received in an opening 58 in end sheet El, and the outer end of shaft 52B is received in an opening 60 in end sheet E2. Each valve member has an arcuate section (62A) which fits over the shaft. This section extends greater than 180° (i.e. between 200° and 240°) so that when installed on its shaft, the valve member will not be dislodged. The arcuate section of the valve member transitions into a generally planar section (64A) whose outer end is upturned as indicated at 66.

Figure 3:
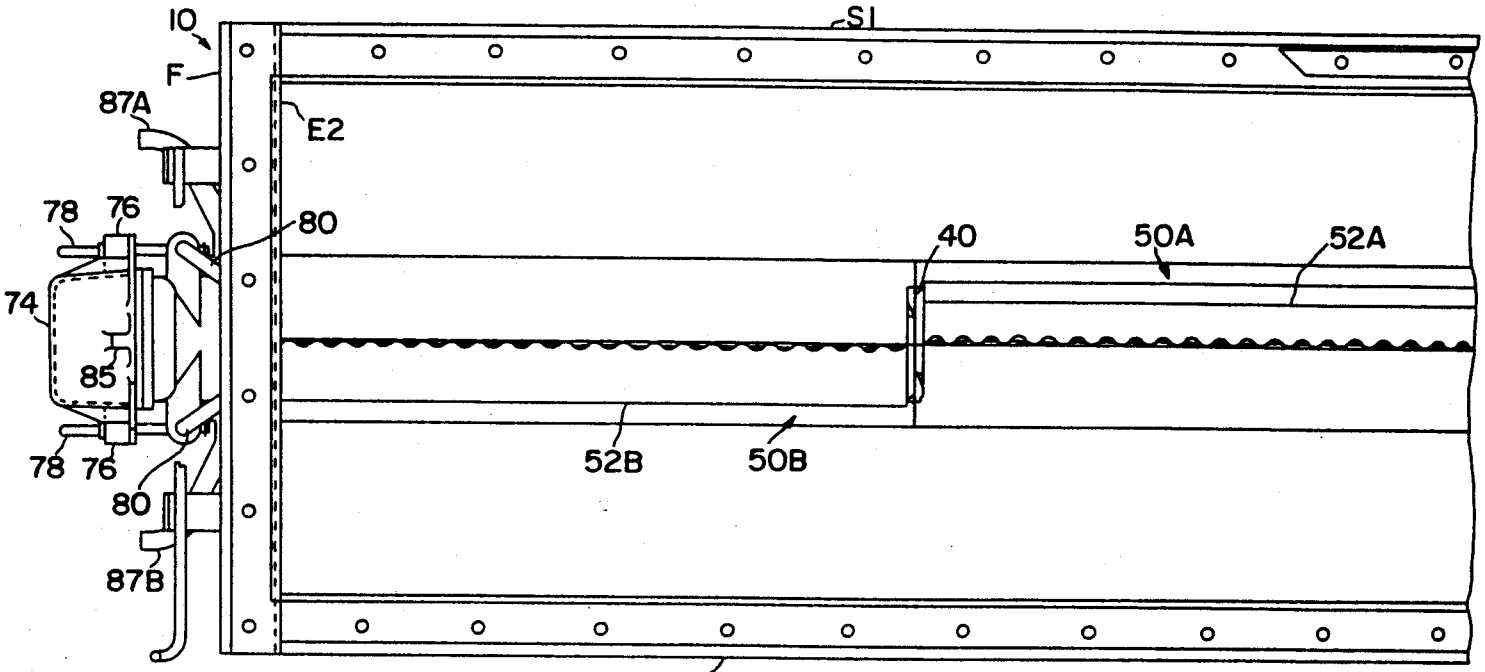
FIG. 3 is a top plan view of the improved outlet of the present invention.

Referring to FIG. 3, it is seen that valves 50A, 50B are installed in cover 14 in a diagonal arrangement. Accordingly, each valve, when opened, allows lading to discharge from one side of the hopper. For proper operation of the outlet, it is important that no gaps are formed between the valves and the bottom cover section in which they are installed. Thus, it is important that the valves be precisely aligned with respect to bottom cover 14 and to each other. If the installation is proper, there are no gaps between the valve member and bottom cover section when the valve is closed, and no lading may inadvertently flow into the outlet. To achieve this alignment, the distance between the center of the respective opening 56A, 56B in spacer 40, and the inner curved wall 68 over cover section 28 must be precise. This is achieved by properly positioning the spacer in recess 38 prior to attaching the spacer and bottom cover sections together This may be done in any convenient manner including, for example, using a ruler to measure the distance, using a feeler gauge whose dimensions correspond to the prescribed distance between the center of the opening and wall 68, or scribing appropriate markings on the spacer so the installer can use the marks to verify positioning. Regardless of the method used, if the opening 56A, or 56B in spacer 40 is correctly positioned with respect to the curved surface 68 of cover section 28 on the one respective side of the cover, the other opening will also be correctly positioned. Now, when the shaft is installed, the rounded outer surface of valve section 62A will mate with curved surface 68 of the respective cover section, and the outer end 64A of the valve will wipe against curved surface 19 of cover section 18 as the valve is opened and closed. No gap between the valve and the cover will occur; and, neither will the valve bind against the cover.

Figure 4:
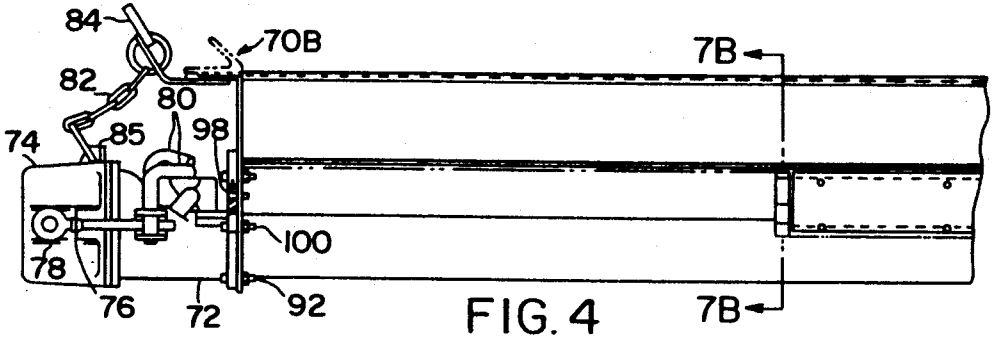
FIG. 4 is a side elevational view of the outlet.
Figure 8:
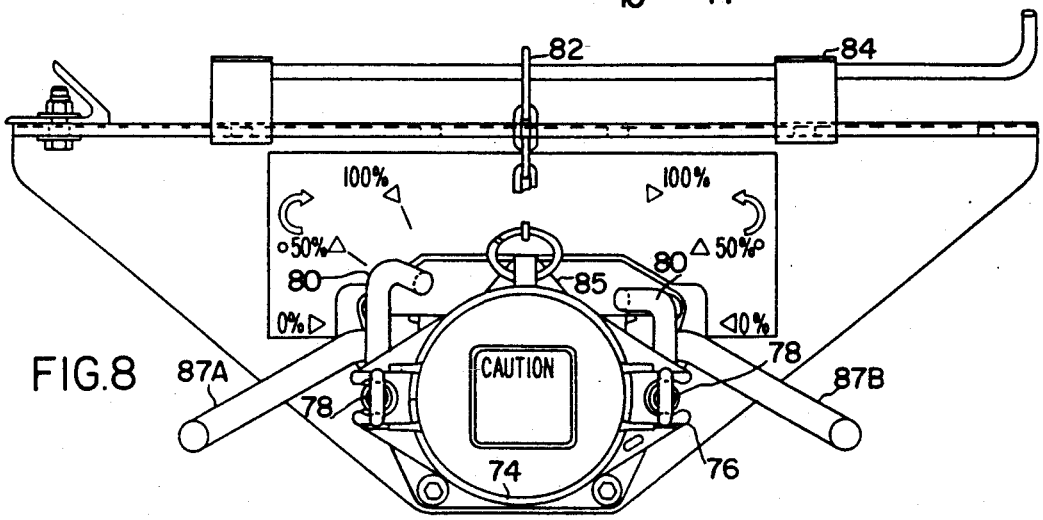

As noted previously, bottom cover 14 attaches to respective end sheets E1 and E2. End adaptors 70A are attached to these end sheets. As shown in FIGS. 4 and 8, each end adaptor includes a horizontally extending discharge tube 72 whose outer end is covered by a removable end cap 74. Various arrangements are known in the art for locking the end cap in place, and for retaining the end cap when it is removed. Cap 74 has notched ears 76 in which are received rotatable locking rods 78. The rods, in turn, are movable by vertically extending handles 80. When in their position shown in FIG. 8, the cap is locked in place. When the handles are turned to rotate the rods and allow removal of cap 74, a chain 82 which extends between a bracket assembly 84 on the adaptor, and an ear 85 on the cap, keep the cap from being misplaced. When the cap is removed, pieces of discharge apparatus connect to the discharge tubes to effect unloading in the manner previously discussed. As particularly shown in FIG. 8, valve handles 87A, 87B extend outwardly of the adaptor. The handles, which are located on either adaptor, allow the unloading operator to open and close either or both valves 50A, 50B, and to control the degree of valve opening. Attachment of the handles to the valve shafts is shown in more detail in FIG. 6. There, it is seen that the outer end of valve shafts 54A, 54B are threaded and that a nut 88 is used to secure the valve handles 87A, 87B on the respective shafts. A bushing assembly 90 is installed on each shaft where the shaft enters the respective adaptors to provide a smooth rotational motion of the valve when its shaft is rotated by the handle.

Referring again to FIG. 5B, the adaptors are attached to the end sheets by, for example, six bolts 92 which are received in the three bolts holes 94 on either side of the end sheet. As previously discussed with respect to installation of the valves to the outlet sections, it is important for the valve shafts to be properly aligned in order to prevent gaps between the valve member and sidewall of the outlet, as well as to prevent binding. This consideration also applies with respect to attachment of the adaptors to the end sheets. Since the shafts extend through a sidewall of the adaptors, any misalignment of an adaptor, and its associated end sheet, could cause either the gap or binding problems Previously, when the end sheet/adaptor assembly was made, the assembler manually adjusted the adaptor relative to the end sheet and then bolted the two together. If there were any slippage between the end sheet and adaptor from the time of alignment to the time the bolting operation was completed, misalignment would result.

As shown in FIG. 5B, two holes 96 are formed in each end sheet. These holes are located on either side of the bottom cover and are intermediate the upper and middle bolt holes 94. Referring to FIG. 4, a corresponding hole 98 is formed in the sidewall of adaptors 70A, 70B. Now, the assembler need only align the respective holes 96, 98 on either side of the bottom cover and then insert pins 100 through the aligned holes. Now, the alignment cannot be changed and the position of the shafts is fixed in place. No gap or binding problems will occur when everything is bolted together.

As a method of manufacturing outlet 10, the assembler first takes a bottom cover 14 and cuts it into two equal length sections 36A, 36B. Next, one of sections is turned around so that it is reversed with respect to the other. The two adjacent ends are now tack welded or otherwise connected together. At the junction between the two sections, a recess 38 is formed in which a bulkhead spacer 40 is inserted into the sub-assembly. The recess is so formed that it fits snugly in place between the two sections and it extends beyond the profile formed by the sections where they abut against the sidewalls of the spacer. In installing the spacer, care is taken to insure the proper spacing between a section 18 of the sidewall of each section and an opening in the spacer in which a valve shaft 54A or 54B is received. Because of the symmetry of the sub-assembly, proper spacing on one side of the sub-assembly insures proper spacing on the other side.

After the sub-assembly is formed with the two cover sections and spacer being permanently attached together, valves 50A, 50B are set in place. The valves are diagonally installed so one valve, when opened, permits discharge of lading through one side of the outlet; while opening of the other valve permits discharge through the opposite side. Next, the completed bottom cover assembly is attached to respective side sheets S1 and S2 and respective end sheets end sheets E1 and E2. Respective adaptors 70A, 70B are mounted to the end sheets to facilitate hook-up of discharge apparatus to the outlet. The end sheets and adaptors have corresponding alignment holes 96, 98 in which pins 100 are inserted to maintain a proper alignment of the valves and the bottom cover assembly while the end adaptors are bolted to the end sheets.

What has been described is an improved pneumatic outlet for use on railway cars such as covered hopper cars. The outlet has a continuously formed extrusion forming a bottom cover of the outlet, this extrusion being separable into separate pieces whose ends are reversible and attachable together to form a bottom cover. Diagonally spaced valves are installed in the assembly and a bulkhead spacer is used for valve installation. This spacer not only provides a mounting the inner ends of the valves, but is so designed that when installed no gaps or deformations are present between the spacer and the cover. This greatly reduces the risk of lading contamination. Other valve installation and alignment features further eliminate the risk of contamination. Besides this substantial reduction in the risk of contamination, the outlet requires fewer components. These combined features help simplify outlet assembly and lower the cost to manufacture the outlet.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. An improved pneumatic outlet for use on a railcar for discharging a lading from a hopper of the railcar comprising:

a bottom cover extending the length of the outlet;

a pair of outlet valves installable in the cover, said valves being mounted on respective valve shafts and installed in the cover in a diagonal arrangement whereby each valve allows discharge of lading from a respective side of the hopper; and, bulkhead means installed in the cover for supporting an inner end of each of the shafts, wherein the cover is in two identical sections, one of said sections being reversed with respect to the other said section and the two sections being mated together to form a unified cover through which lading flows during discharge.

2. The improved outlet of claim 1 wherein said bulkhead means comprises a spacer attached to mating ends of said cover sections.

3. The improved outlet of claim 2 wherein a recess is formed at the mating ends of said sections and the spacer is installed in said recess, said spacer extending beyond an outer wall of the respective sections.

4. The improved outlet of claim 3 wherein respective contours of said mating ends overlay respective sidewalls of said spacer so no gaps are present between the spacer and either mating end.

5. The improved outlet of claim 3 wherein the spacer has a pair of openings in each of which an inner end of a respective one of said valve shafts is received.

6. The improved outlet of claim 5 wherein said openings are spaced openings and the distance between the respective openings and a sidewall of the cover are such that there are no gaps between the valves and the cover, and the valves and cover do not bind together.

7. The improved outlet of claim 5 wherein the mating ends of said sections are inwardly angled to form said recess.

8. The improved outlet of claim 7 wherein said mating sections of said cover are joined together by welding, said spacer being welded to both of said sections.

9. The improved outlet of claim 8 further including a pair of side sheets and a pair of end sheets to which respective sides and ends of the bottom cover are attached.

10. The improved outlet of claim 9 wherein outer ends of said valve shafts are attached to the respective end sheets.

11. The improved outlet of claim 10 further including adaptors attached to each of the end sheets for connecting a lading discharge apparatus to the outlet, the outlet further including means for aligning the outer end of the valve shafts with the respective adaptors to properly position the valves in the outlet.

12. The improved outlet of claim 11 wherein the respective end sheets to which the valve shafts are attached and their associated adapters have corresponding aligned openings therein, and the means for aligning includes a pin inserted through the aligned openings when the valve shafts are properly positioned.

13. A pneumatic outlet for use on a railcar for discharging a lading from a hopper of the railcar comprising:

a bottom cover extending the length of the outlet, said cover being in two identical sections one of which is reversed with respect to the other, and the two sections being mated together to form a unified cover through which lading flows during discharge;

a pair of side sheets and a pair of end sheets to which the respective sides and ends of the bottom cover are attached;

outlet valves installable in the cover, said valves being mounted on respective valve shafts and installed in the cover in a diagonal arrangement for each valve to allow discharge of lading from a respective side of the hopper, the outer ends of said valve shafts being mounted to the respective end sheets; and, bulkhead means installed in the cover for supporting an inner end of each of the shafts, said bulkhead means comprising a spacer attached to mating ends of said cover sections, and the mating ends of said bottom cover sections each having a recess formed therein for inserting of said spacer in said bottom cover, inner ends of said respective valves shafts being mounted to said spacer.

14. The improved outlet of claim 13 wherein respective contours of said mating ends overlay respective sidewalls of said spacer so no gaps are present between the spacer and either mating end.

15. The improved outlet of claim 14 wherein said spacer has spaced openings therein in which respective said inner ends of said shafts are received, and the distance between the respective openings and a sidewall of the cover are such that there are no gaps between the valves and the cover, and the valves and cover do not bind together.

16. The improved outlet of claim 14 further including an adaptor attached to each of the end sheets for connecting a lading discharge apparatus to the outlet, and the outlet further includes means for aligning the outer end of the valve shafts with the respective adaptors to correctly position the valves in the outlet.

17. The improved outlet of claim 16 wherein the end sheets to which the valve shafts are attached and the respective adaptors have corresponding aligned openings therein, and the means for aligning includes a pin inserted through the aligned openings when the respective valve shafts are properly positioned in the outlet.

18. A method of making a pneumatic outlet for use on a railcar to discharge a lading from a hopper of the railcar comprising:

taking a bottom cover extending the length of the outlet and cutting it into two sections and reversing one of said sections with respect to the other;

mating the two sections together to form a unified cover through which lading flows during discharge;

attaching the formed bottom cover to respective side sheets and end sheets;

forming a recess in each of mating ends of said bottom cover sections; and, installing a bulkhead in the cover at the mating said cover sections by inserting said bulkhead in the recesses.

19. The method of claim 18 further including installing outlet valves mounted on respective valve shafts in said bottom cover, said installing of said valves comprising installing said valves in the cover in a diagonal arrangement, mounting an outer end of each of the valve shafts on one of the respective end sheets, and installing the inner end of the shafts on the bulkhead.

20. The method of claim 19 wherein said bulkhead comprises a spacer and said installing of said bulkhead comprises installing said spacer at said mating ends of said cover sections so that the respective contours of said mating ends overlay respective sidewalls of said spacer, and the method further includes welding said mating ends of said cover sections and said spacer together so that there are no gaps between the spacer and either mating end of said bottom cover sections.

21. The method of claim 20 wherein installing the inner ends of said valve shafts includes installing said shafts on said spacer, said spacer having spaced openings therein in which said valve shafts are received, and said installing of said spacer comprising installing said spacer so the distance between the respective openings and a sidewall of said cover are such that there are no gaps between the valves and the cover, and said valves and cover do not bind together.

22. The method of claim 20 further including attaching an adaptor to each end of the outlet for connecting a lading discharge apparatus to the outlet.

23. The method of claim 22 further including aligning the outer end of the valve shafts with the respective adaptors for correctly positioning the valves in the outlet.

24. The method of claim 23 wherein aligning the valves includes aligning corresponding alignable openings in the respective end sheets and adaptors and inserting a pin through the aligned alignable openings, the respective valve shafts being properly positioned when the alignable openings are aligned.

* * * * *